US006053187A

United States Patent [19]

Altomonte

[11] Patent Number: 6,053,187

[45] Date of Patent: Apr. 25, 2000

[54] SELF CLEANING PIPE SYSTEM

[76] Inventor: Fred Altomonte, 138 Admiralty Loop, Staten Island, N.Y. 10309

[21] Appl. No.: 09/158,865

[22] Filed: Sep. 23, 1998

[51] Int. Cl.[7] ..... B08B 9/032

[52] U.S. Cl. ..... 134/169 C; 137/15

[58] Field of Search ..... 134/166 C, 169 C; 137/13, 15, 240, 896, 897; 454/55

[56] References Cited

U.S. PATENT DOCUMENTS

| | | | |
|---|---|---|---|
| 2,821,205 | 1/1958 | Chilton et al. | 137/13 |
| 3,420,268 | 1/1969 | Mueller | 137/897 |
| 3,702,619 | 11/1972 | Son | 137/896 X |
| 4,795,495 | 1/1989 | Dobson, Sr. | 134/8 |
| 4,985,763 | 1/1991 | Fraser | 358/100 |
| 5,035,796 | 7/1991 | Saylor | 210/198 |
| 5,127,429 | 7/1992 | Kempf et al. | 137/240 |
| 5,588,171 | 12/1996 | Hamann | 15/104 |

*Primary Examiner*—Philip R. Coe
*Attorney, Agent, or Firm*—Goldstein & Canino

[57] ABSTRACT

A self cleaning pipe system, comprising a main pipe having a pipe wall which defines a pipe interior, and has a pipe circumference. The main pipe normally carries liquid or semi-liquid substances in a flow direction. A plurality of nozzle arrays are located along the main pipe. Each nozzle array comprises at least one, and preferably three or more nozzle assemblies. Each nozzle assembly includes a nozzle point which is directed through the pipe wall toward the pipe interior. A high pressure water supply is connected to the nozzle points to selectively create high pressure water jets in the flow direction, the jets all aimed at a convergence point. The nozzle arrays are selectively activated and deactivated to create a high pressure wave which clear the pipe of debris, and cleans the pipe.

9 Claims, 6 Drawing Sheets

SELF CLEANING PIPE SYSTEM

BACKGROUND OF THE INVENTION

The invention relates to a self cleaning pipe system. More particularly, the invention relates to a pipe system which incorporates a high-pressure cleaning system within the pipe itself to facilitate automatic cleaning of the pipe.

Pipes are most efficient when they are carrying only liquids. When carrying a pure liquid, an ordinary pipe can carry the liquid a considerable distance while requiring only minimal pumping energy to sustain flow.

However, difficulties occur when piping viscous liquids, or liquids containing large solids. Often the solids can accumulate at a certain point in the pipe, causing a "clog". A clog can either slow the flow of the pipe, thus requiring greater energy to pump the liquid through the pipe, or can stop flow completely—especially in low pressure pipes.

Sewer pipes are particularly susceptible to clogs. They typically have a considerable quantity of solids passing through, and have an overall low pressure flow. This combination of low pressure and high concentration of solids leads to frequent clogging problems. Toilet tissue can increase the tendency to clog by facilitating the formation of large clumps with other solids.

The problem with clearing clogs from sewer pipes is that they are difficult to access. Most sewer pipes are buried in the ground, leaving very few points where access can be obtained. Sometimes clearing a clog actually requires excavation to reach the clogged pipe. Overall, a clog can be an expensive and time consuming operation. Further, it can require that the pipe be taken "off-line" for a significant time until the clog is cleared.

SUMMARY OF THE INVENTION

It is an object of the invention to produce a sewer pipe system which has a self cleaning system, for automatically cleaning the sewer pipe. Accordingly, a series of high pressure ports are provided on the sewer pipe which may be activated to dislodge solid particles or to simply thoroughly clean the inner walls of the pipe.

It is a further object of the invention to effectively clean a sewer pipe that is buried within the ground, without the necessity of disturbing the pipe or the ground within which it is located. Accordingly, a maintenance free system is provided which must simply be activated when cleaning is needed.

It is a still further object of the invention that cleaning progresses rapidly, and that not only is a clog cleared from a particular location in the pipe, but the clogging debris is flushed from the pipe. Accordingly, the high pressure ports are activated sequentially, in rapid succession, to create a high pressure wave which carries the debris along the pipe until it has traveled fully through the pipe.

The invention is a self cleaning pipe system, comprising a main pipe having a pipe wall which defines a pipe interior, and has a pipe circumference. The main pipe normally carries liquid or semi-liquid substances in a flow direction. A plurality of nozzle arrays are located along the main pipe. Each nozzle array comprises at least one, and preferably three or more nozzle assemblies. Each nozzle assembly includes a nozzle point which is directed through the pipe wall toward the pipe interior. A high pressure water supply is connected to the nozzle points to selectively create high pressure water jets in the flow direction, the jets all aimed at a convergence point. The nozzle arrays are selectively activated and deactivated to create a high pressure wave which clear the pipe of debris, and cleans the pipe.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
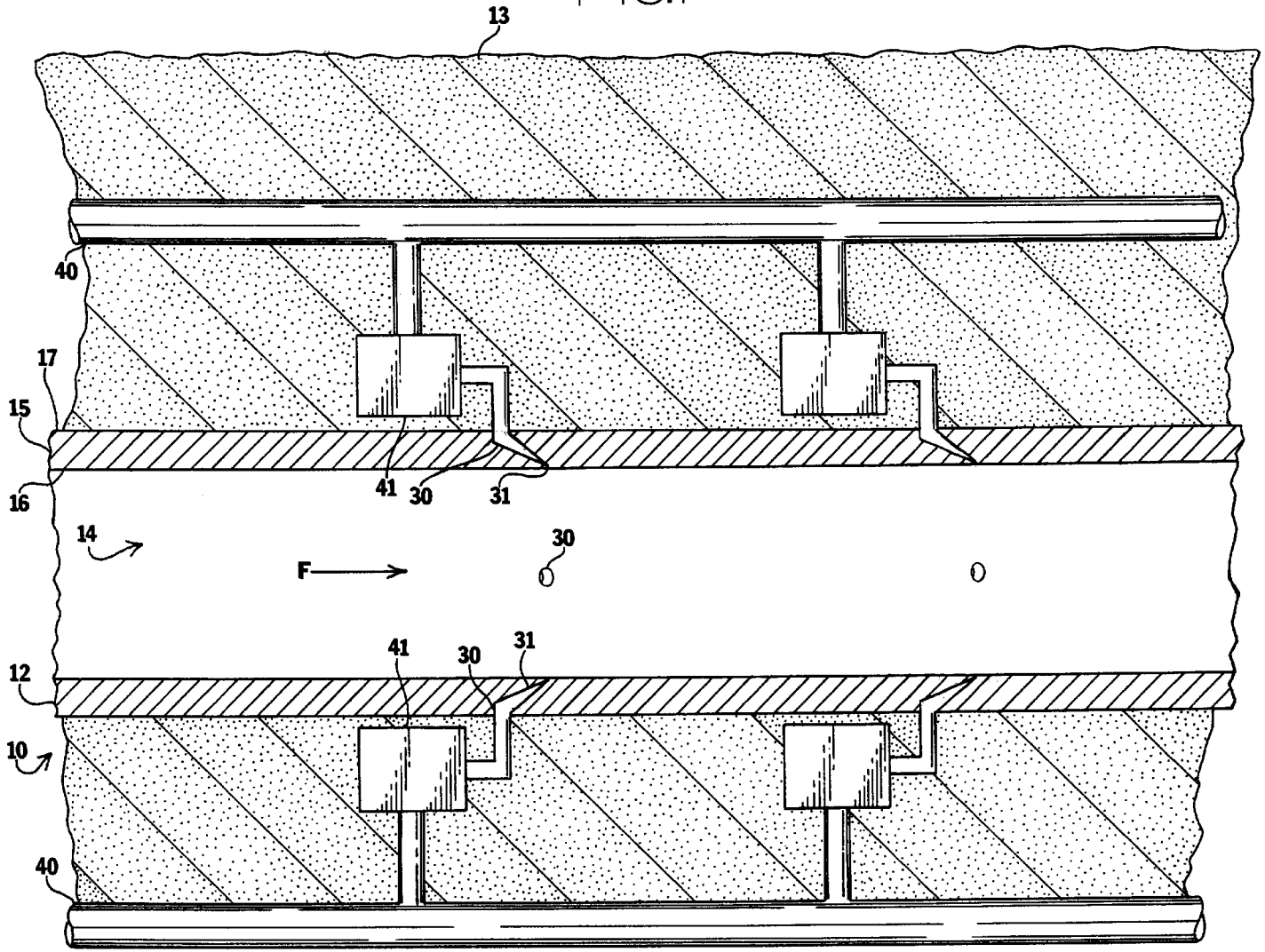
FIG. 1 is a cross sectional view, illustrating a buried pipe having the cleaning system incorporated therewith.

FIG. 1 illustrates a self cleaning pipe system 10, comprising a main pipe 12, which is located beneath a ground surface 13. The main pipe 12 has a main pipe wall 15 which defines a main pipe interior 14. The main pipe wall 15 includes a main pipe inner wall 16, and a main pipe outer wall 17—which is also known as the main pipe circumference. The main pipe has a flow direction, indicated by arrow F in FIG. 1. Substances normally carried by the main pipe ordinarily travel in the flow direction.

According to the present invention, nozzle assemblies 30 are embedded in the main pipe wall 15. The nozzle assemblies 30 have a nozzle point 31 which is located at the main pipe inner wall 16. Each nozzle assembly 30 is capable of directing a high pressure spray toward the main pipe interior 14. The nozzle points 31 are generally pointed in the flow direction F.

Generally, the nozzle assemblies 30 are arranged in nozzle arrays, which comprise two or more nozzle assemblies that are located at the same longitudinal point along the pipe. For example, in the embodiment illustrated in FIG. 1, each nozzle array comprises four nozzle assemblies 30—one shown above the main pipe wall 15, one illustrated below the main pipe, one shown on the inner wall 16 midway between the two just previously described, and one which has been removed in sectioning the pipe for FIG. 1.

The nozzle arrays are located a short distance away from each other, for the entire length of the main pipe. The precise distance between nozzle arrays is best determined by empirical testing which would indicate the maximum distance between nozzle arrays that would still allow effective cleaning to be conducted.

In the embodiment shown in FIG. 1, water is supplied to the nozzle assemblies 30 by high pressure water lines 40. A local valve 41 is connected between each nozzle assembly 30 and one of the high pressure water lines 40. The local valve 41 thus selectively either enables or disables its associated nozzle assembly.

Figure 2:
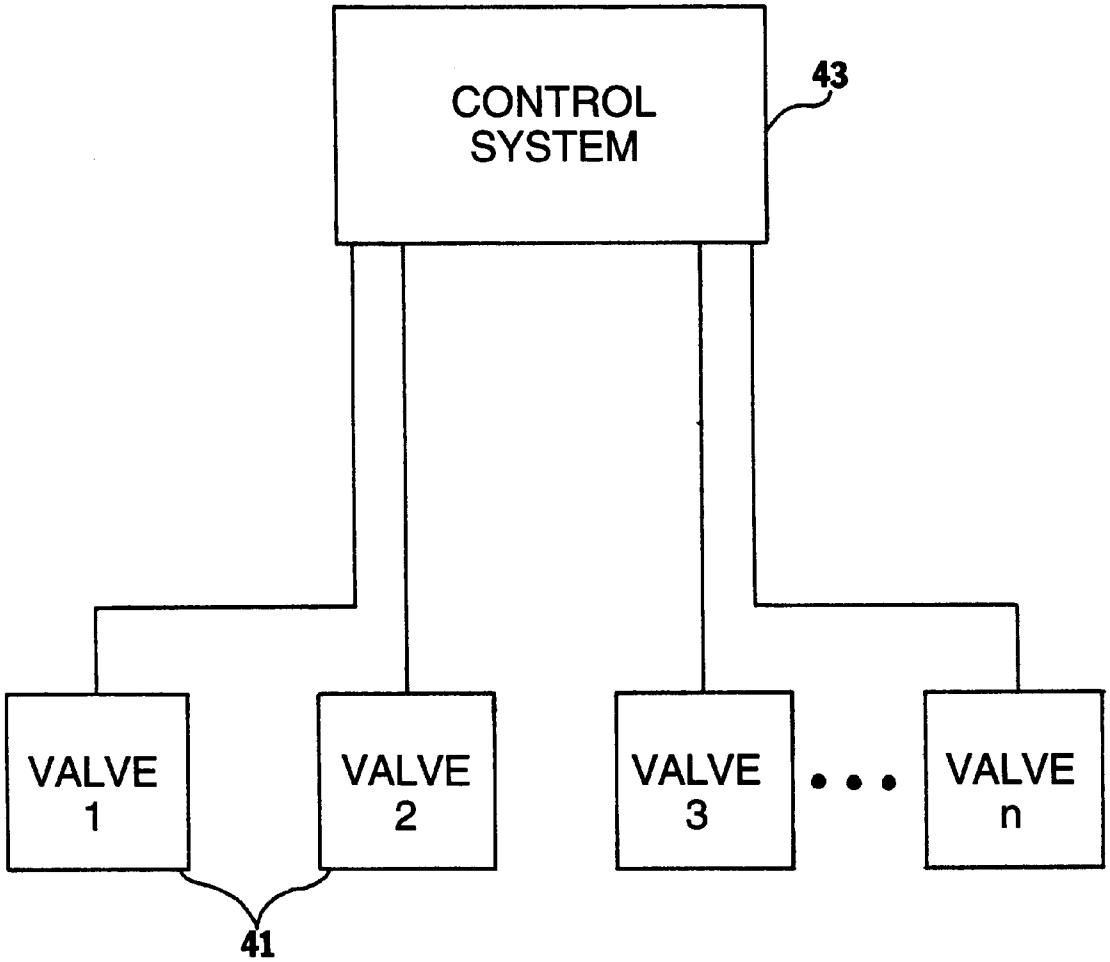
FIG. 2 is a block diagram, illustrating functional interconnection of various components of the system illustrated in FIG. 1.

FIG. 2 is a block diagram illustrating functional interconnection of the local valves 41. A control system 43 is electrically connected to each of the local valves 41. The control system 43 thereby selectively turns on each of the local valves 41 in a pre-determined sequence. Generally, all local valves 41 for each nozzle array are enabled simultaneously.

Figure 3:
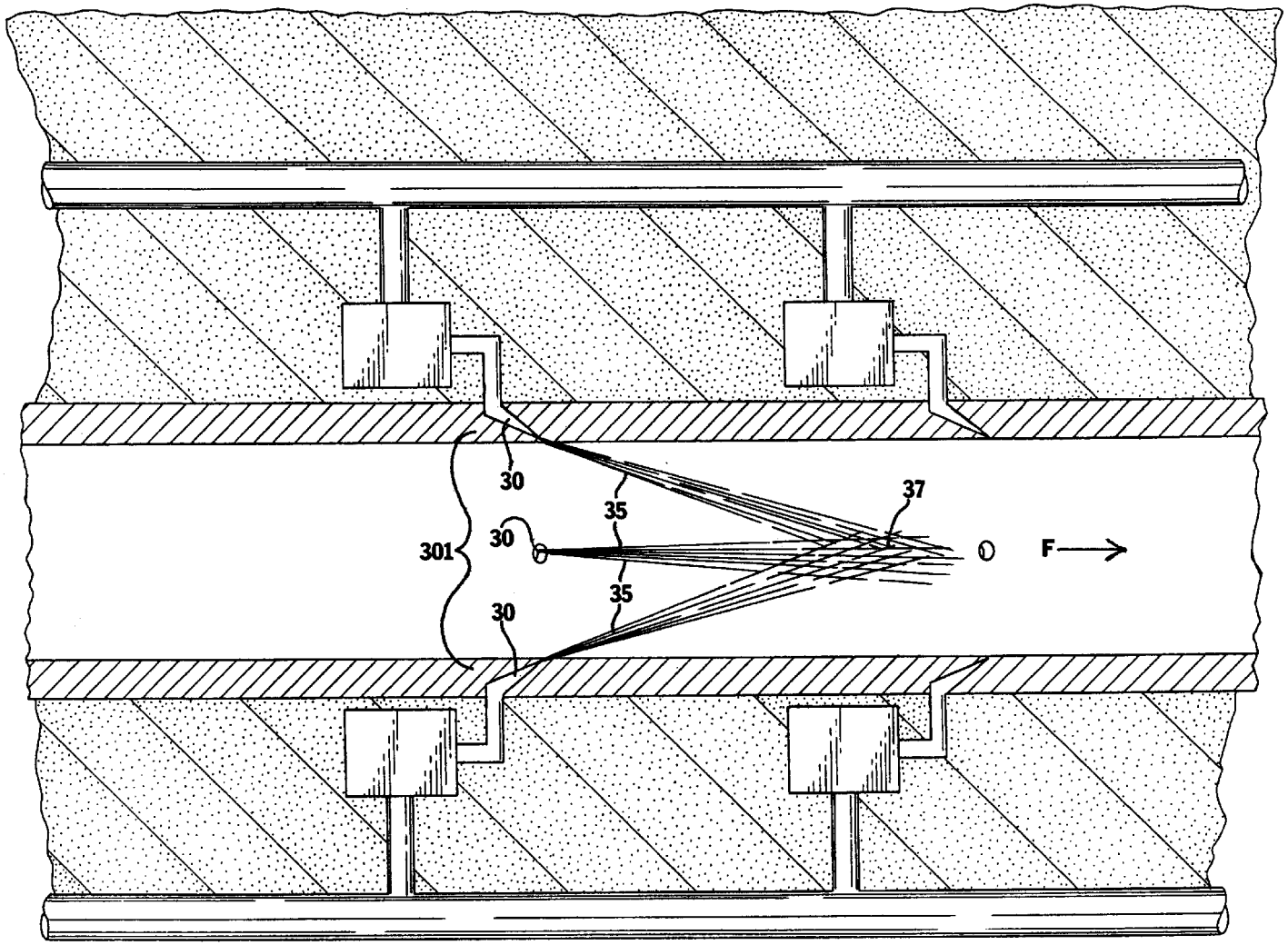
FIG. 3 and FIG. 4 is a temporal sequence, illustrating the consecutive firing of a high pressure spray by the valve arrays located along the pipe.
Figure 4:
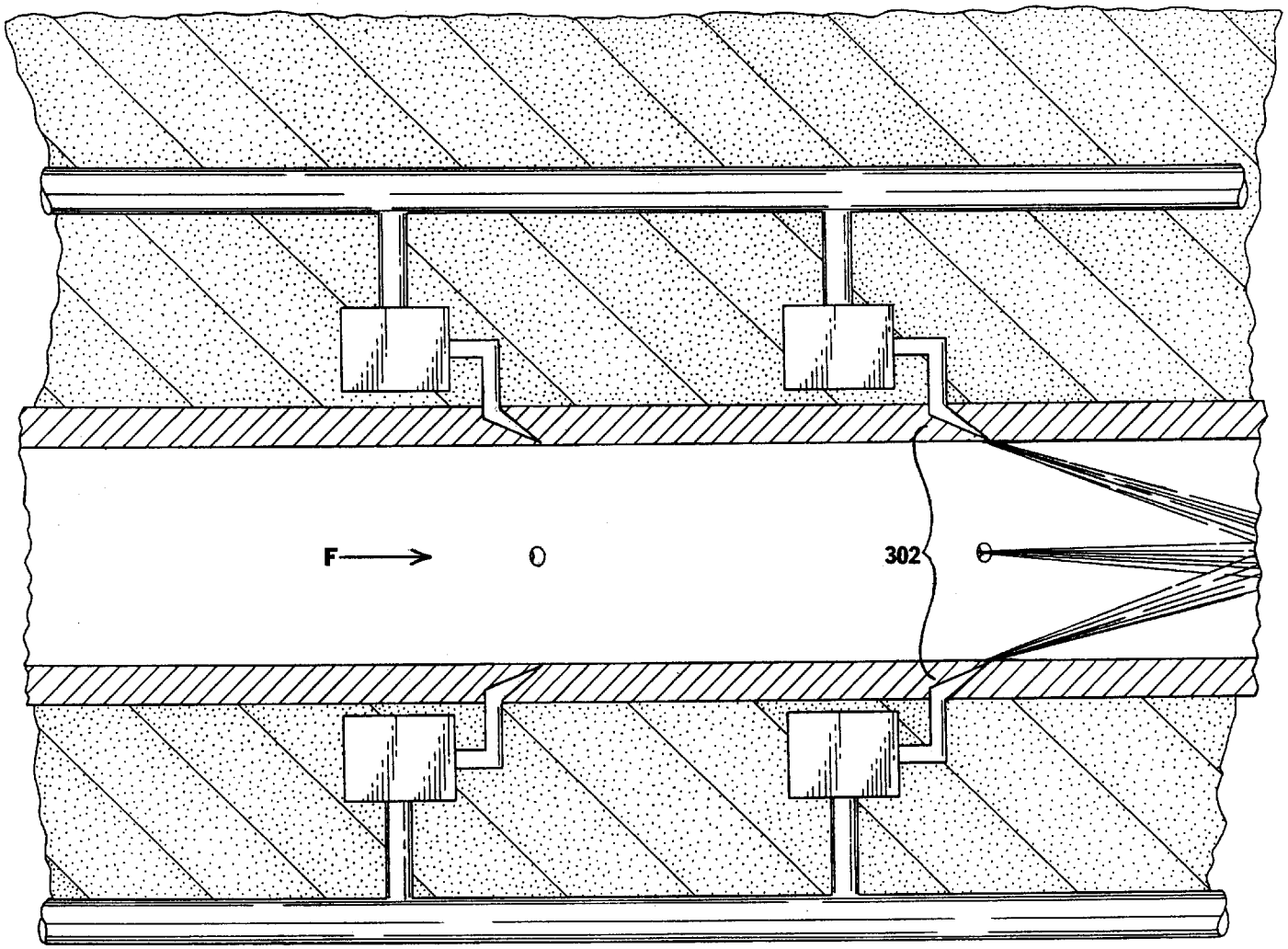

FIG. 3 and FIG. 4 are temporal sequences which illustrate a portion of a cleaning operation. In FIG. 3 one of the nozzle arrays, which may be referred to as a first nozzle array 301, has been activated. Thus, the nozzle assemblies 30 in that nozzle array are shown spraying a high pressure jet 35. The high pressure jets 35 are aimed at a convergence point 37 centered within the pipe. The nozzle points 31 are oriented so that the high pressure jets 35 each form a small angle with the flow direction F. Preferably the high pressure jets form between a 5 and 45 degree angle with the flow direction F. In this way, the high pressure jets 35 work together to help clear a clog which is likely centered within the pipe.

FIG. 4 is a temporal step following FIG. 3, wherein the first nozzle array 301 has been deactivated, and a second nozzle array 302 has been activated. The second nozzle array 302 is located a short distance "down" the pipe from the first nozzle array 301, in the flow direction F. The rapid activation of the second nozzle array 302 after the deactivation of the first nozzle array 301 creates a wave which will carry debris through the pipe in the flow direction F. Additional nozzle arrays are spaced along the main pipe following the second nozzle array 302 in the flow direction.

Figure 5:
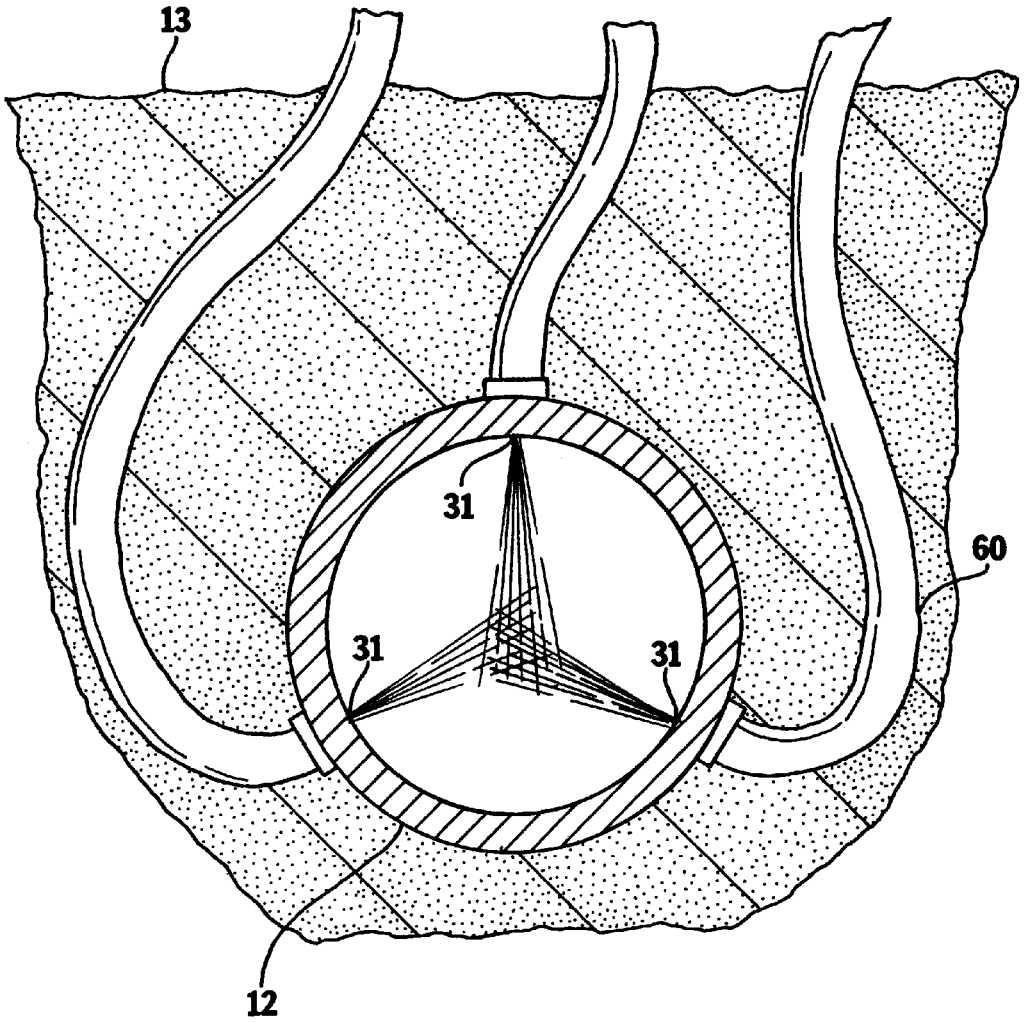
FIG. 5 illustrates an alternate embodiment of the cleaning system, wherein a separate hose is connected to each spray nozzle and is brought above ground therefrom.

FIG. 5 illustrates a further embodiment of the self cleaning pipe system 10. According to this embodiment, the nozzle array comprises three nozzle assemblies arranged 120 degrees apart on the pipe circumference. A nozzle assembly tube 60 is attached to the pipe 12 at each nozzle point 31. Thus, a separate nozzle assembly tube 60 is present for each nozzle point 31. The nozzle assembly tubes 60 extend to a point above the ground surface 13.

Figure 6:
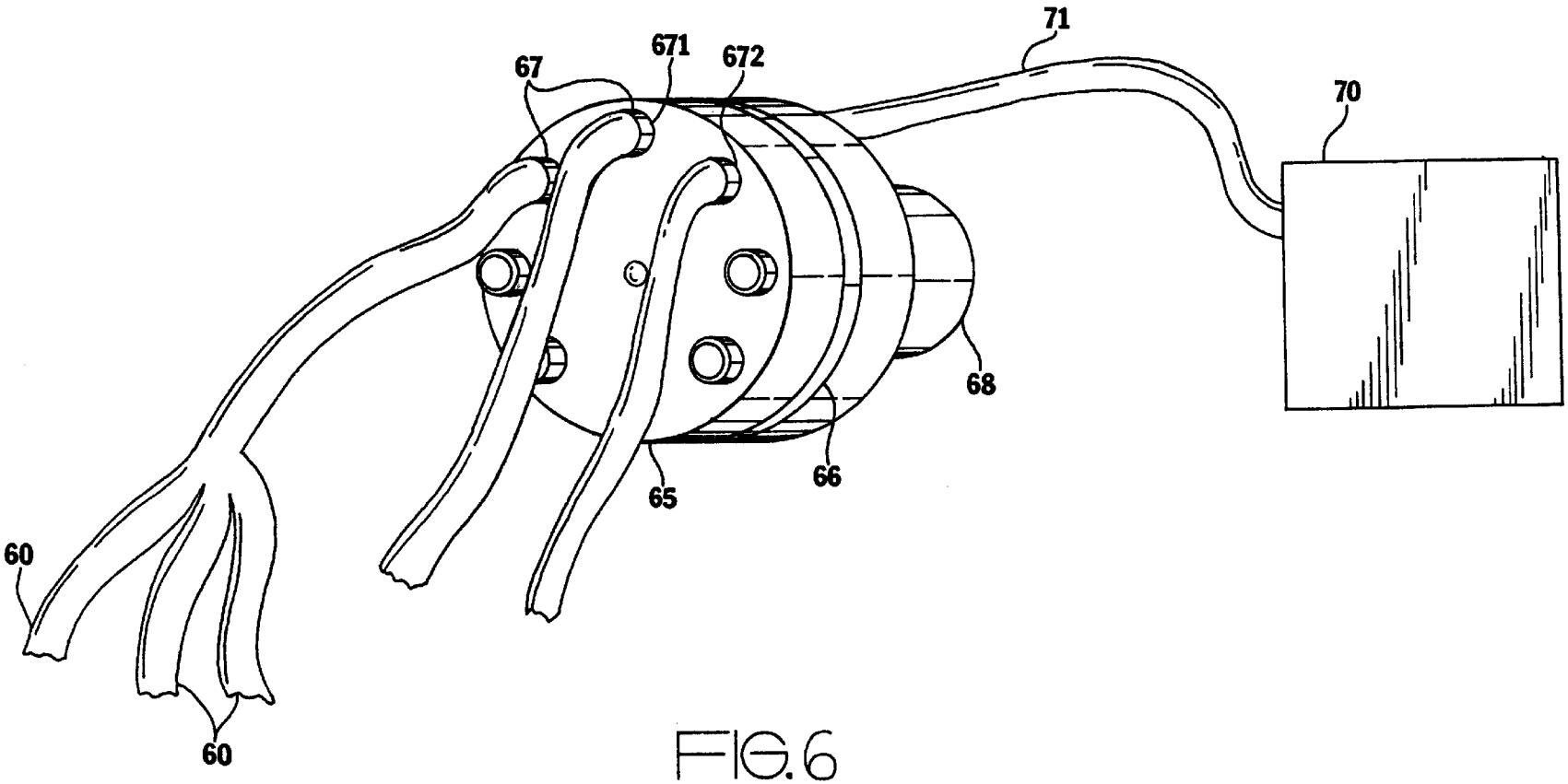
FIG. 6 illustrates a pumping and control valve according to the alternate embodiment of FIG. 5, wherein each of the hoses are directly connected to the control valve.

Referring now to FIG. 6, the nozzle assembly tubes 60 are connected to a selector valve 65. The selector valve 65 comprises a plurality of ports 67 which are each selectively enabled. The nozzle assembly tubes 60 for each nozzle array are connected together, and then are connected to one of the ports 67. The connection of the nozzle assembly tubes 60 together may take place above ground or below ground.

The selector valve 65 is connected to a high pressure water supply 70 with a high pressure water supply feed 71. The selector valve 65 comprises a selector disk 66 which is rotated by a motor 68. The selector disk 66 selectively connects one of the ports 67 with the high pressure water supply feed 71, thus enabling one of the nozzle arrays. The speed of selection and enablement of the nozzle arrays is controllable by simply controlling the speed of rotation of the selector disk 66, which may be easily accomplished by controlling the motor 68. Among the ports are a first port 671 and a second port 672. The first port 671 is connected to the first nozzle array, and the second port 672 is connected to the second nozzle array, etc.

The embodiment of FIG. 5 and FIG. 6 is preferred, because the selector valve 65 is located above ground. Thus, no moving parts are located within the ground. This is important to ensuring that the self cleaning pipe system itself is easily serviceable.

What is claimed is:

1. A self cleaning pipe system, comprising:

a main pipe having a main pipe wall which defines a main pipe wall interior and has a main pipe wall outside and a main pipe wall inside;

a plurality of nozzle arrays, each nozzle array having at least one nozzle assembly, the nozzle assemblies each having a nozzle point which extends through the main pipe wall and is directed at the main pipe wall interior; and a high pressure water supply, connected to the nozzle arrays, selectively enabling the nozzle arrays so that each nozzle point directs a high pressure water jet toward the pipe interior substantially oriented toward a flow direction of fluid through the pipe.

2. The self cleaning pipe as recited in claim 1, wherein each nozzle array comprises at least two nozzle assemblies, wherein the nozzle assemblies for each nozzle array are located at the same point along the pipe, the nozzle arrays are spaced apart along the pipe.

3. The self cleaning pipe as recited in claim 1, wherein the nozzle points for each nozzle array direct the high pressure water jets therefrom toward a common convergence point, and wherein the high pressure water jets form a small angle.

4. The self cleaning pipe as recited in claim 3, wherein the small angle is between 5 and 45 degrees.

5. The self cleaning pipe as recited in claim 4, wherein the high pressure water supply comprises at least one high pressure water tube which extends along the main pipe, parallel thereto, and wherein each nozzle assembly further comprises a local valve connected between the high pressure water tube and the nozzle point therefor.

6. The self cleaning pipe system as recited in claim 5, further comprising a control system, for selectively enabling all local valves associated with one of the nozzle arrays, then deactivating all of said local valves, then enabling the local valves associated with another nozzle array.

7. The self cleaning pipe system as recited in claim 4, further comprising a selector valve having a plurality of ports, and wherein each nozzle assembly further comprises a nozzle assembly tube that is directly connected between one of the ports of the selector valve and the nozzle point.

8. The self cleaning pipe system as recited in claim 7, wherein the high pressure water supply is connected to the selector valve, wherein the selector valve is located above ground and further comprises a selector disk and a motor for rotating the selector disk, the selector disk selectively connecting one of the ports with the high pressure water supply as the selector disk rotates.

9. The self cleaning pipe system as recited in claim 8, wherein each nozzle array comprises three nozzle assemblies located one hundred twenty degrees apart around the main pipe circumference.

* * * * *